United States Patent [19]

Giordano et al.

[11] 3,965,014

[45] June 22, 1976

[54] ANIONIC FABRIC CONDITIONERS

[75] Inventors: Annie Sue Giordano, Piscataway, N.J.; Richard Lerda Burke, San Diego, Calif.; Harold Eugene Wixon, New Brunswick, N.J.

[73] Assignee: Colgate-Palmolive Company, New York, N.Y.

[22] Filed: Dec. 7, 1972

[21] Appl. No.: 311,720

[52] U.S. Cl. ..... 252/8.7; 252/8.6; 252/8.8; 252/108; 252/546; 252/551; 252/554; 252/555

[51] Int. Cl.[2] ..... D06M 13/20

[58] Field of Search ..... 252/8.7, 8.75, 8.8, 252/8.6, 551, 108, 555, 554, 546

[56] References Cited

UNITED STATES PATENTS

| | | | |
|---|---|---|---|
| 3,578,591 | 5/1971 | Lazaridis et al. | 252/8.7 |
| 3,617,207 | 11/1971 | Benson et al. | 252/8.7 X |
| 3,766,062 | 10/1973 | Wixon | 252/8.7 |
| 3,778,226 | 12/1973 | Kissa | 252/8.7 X |

*Primary Examiner*—Stephen J. Lechert, Jr.
*Attorney, Agent, or Firm*—Steven J. Baron; Norman Blumenkopf; Herbert S. Sylvester

[57] ABSTRACT

Aqueous solutions of anionic surfactants are effective fabric softeners which can be sprayed directly onto washable textile fabrics. In addition, the solutions impart soil-release properties to the fabrics. A silicone resin may be incorporated into the solution to provide a spray-on ironing aid.

3 Claims, No Drawings

ANIONIC FABRIC CONDITIONERS

BACKGROUND OF THE INVENTION

This invention relates to a composition for treating a textile substrate to impart softening, smoothness, and soil-release characteristics thereto, which composition can be spray-dispersed onto the textile to be treated.

The washing agents commonly applied in laundering consist of soap and/or the synthetic detergents, such as long-chain alkyl sulfates or sulfonates and fatty alcohol condensation products which are usually mixed with builder salts, such as alkali carbonates, silicates, and/or phosphates. These builder salts have a tendency, however, to react with the calcium and magnesium ions present in the ordinary washing water, whereby salts are precipitated which are liable to be deposited onto the fibers of the textile during the washing step, especially if detergents are used that are not capable of keeping the soil and other undissolved substances sufficiently suspended in the washing solution. The mineral salts deposited onto the fibers render the fabrics liable to be weakened, particularly at those parts of the textile goods which are exposed to friction or rubbing, as, for instance, the edges of collars or sleeves. In addition, the deposited mineral salts give the laundered textiles a poor, boardy feel, particularly at those areas of the fabric which are exposed to friction and creasing, such as collars and cuffs. This poor hand of laundered fabrics and resulting discomfort during use have in part resulted in the creation of a large and expanding market for softener formulations capable of improving the softness or "hand" of laundered textiles. It has been found that the treatment of such materials with softening agents improves their softness of feel and may prolong the useful life of the textile materials. Softeners also facilitate ironing by lubricating the fibers so that wrinkling is reduced and friction between fibers and the iron is reduced. Additionally, it has been found that treatment of fabrics with softeners generally results in a fabric having a reduced tendency to accumulate electrical charges which create undesirable static cling.

The genesis of synthetically produced textile fibers has brought about a tremendous effort in the textile industry along numerous avenues. There has been much research effort directed to the improvement of these synthetic fibers per se, as well as improved blends of synthetically produced fibers with natural fibers, i.e., cellulose fibers or keratinous fibers. Results of this research have been successful, and the direction of research has been directed from the synthetic polymer per se and/or blends of said polymers with other, naturally occurring, fibers, and, more specifically, to the physical characteristics and/or endurance properties of garments produced from synthetic fabrics and/or fabric produced from blends of synthetic fibers and naturally occurring fibers.

Much research has been directed to the attainment of a garment having improved soil-release properties. Many of the synthetically produced fibers that are presently being incorporated into blends with naturally occurring fibers have a propensity to accept and retain oily grime and dirt. Accordingly, when the garment is being worn the soil and/or oily materials accumulate on the garment and settle on the fabric. Once the garment becomes soiled, it is then subjected to a cleaning process for removal of the dirt and/or oily deposits, and only a dry cleaning process will successfully clean the garment.

The cleaning process normally employed, however, is washing in a conventional home washing machine. During a wash cycle, it is virtually impossible to remove all of the soil and/or oily stains from the garment, and secondly, assuming that the undesirable materials are removed from the garment or a fairly clean garment is being washed, soil remaining in the wash water is redeposited onto the garment prior to the end of the wash cycle. Hence, when the garment is removed from the washing machine and subsequently dried, it has not been properly cleaned. Such a condition, heretofore unavoidable, is quite disadvantageous in that the garment after being worn never again assumes a truly clean appearance, but instead tends to gray and/or yellow due to the soil and/or oily materials deposited and remaining thereon. Further use and washing of the garment increases the intensity of the graying to the point that ultimately the garment is unacceptable for further wear due to its discoloration.

The composition of the present invention ameliorates the softening problem as well as the soiling problem as hereinafter described.

The problem heretofore confronted with fabrics having synthetic fibers incorporated therein, or made entirely of synthetic fibers, has been that the synthetic fibers, as well as being hydrophobic, are oleophilic. Therefore, while the oleophilic characteristics of the fiber permit oil and grime to be readily embedded therein, the hydrophobic properties of the fiber prevent water from entering the fiber to remove contaminants therefrom.

Attempts have been made to reduce the oleophilic characteristics of these synthetic fibers by coating the fibers with a coating that is oleophobic, i.e., will hinder the attachment of soil or oily materials to the fibers. Many polymer systems have been proposed which are capable of forming a film around the fibers that constitute the textile material, particularly acid emulsion polymers prepared from organic acids having reactive points of unsaturation. These treating polymers are known as soil-release agents.

The term "soil release" in accordance with the present invention refers to the ability of the fabric to be washed or otherwise treated to remove soil and/or oily materials that have come into contact with the fabric. The present invention does not wholly prevent the attachment of soil or oily materials to the fabric, but hinders such attachment and renders the heretofore uncleanable fabric now susceptible to a successful cleaning operation. While the theory of operation is still somewhat of a mystery, soiled, treated fabric when immersed in detergent-containing wash water experiences an agglomeration of oil at the surface. These globules of oil are then removed from the fabric and rise to the surface of the wash water. This phenomenon takes place in the home washer during continued agitation, but the same effect has been observed even under static conditions. In other words, a strip of polyester/-cotton fabric treated with a dilute solution of the composition of the present invention and soiled with crude oil, when simply immersed in a detergent solution will lose the oil even without agitation.

Concentrated solutions of soil-release agents have been padded onto fabrics by textile manufacturers to impart a permanent soil-release finish to the fabric. As the amount of soil-release agent on the fabric is increased, the capability of the fabric to release soil is increased. However, fabrics with this permanent soil-release finish possess many disadvantages. As the amount of soil-release agent on the fabric is increased, the fabric has a tendency to become stiffer and lose the desirable hand characteristic of the fabric. Fabrics with a heavy application of soil-release agent do not have the same desirable appearance and hand as the same fabrics without the soil-release coating. Furthermore, practically speaking, there is a set range of soil-release agent that can be applied, dictated by commercial success.

SUMMARY OF THE INVENTION

It has now been discovered that dilute solutions of anionic surfactants give unexpectedly good softening and a smooth, non-scratchy, soft feeling to natural and synthetic fabrics when sprayed directly onto the fabrics. After the treated fabrics are ironed or otherwise dried, they have good soil-release chracteristics. Even when used in very dilute solutions, such as about 0.5 to 1.0 percent, the anionics provide excellent softness and soil release.

The anionic surfactants which can be used in the fabric conditioning compositions of the present invention include the alkyl benzene sulfonates wherein the alkyl group has from about 10 to 20 carbon atoms, alkyl toluene sulfonates wherein the alkyl group has from about 10 to 20 carbon atoms, sulfated or sulfonated aliphatic alcohols having from about 10 to 20 carbon atoms, ethoxylated alcohol sulfates comprising a $C_{10}$ to $C_{20}$ alcohol ethoxylated with from about 1 to 6 moles of ethylene oxide, soaps of fatty acids having from 10 to 20 carbon atoms, olefin sulfonates of from 10 to 20 carbon atoms derived from alpha olefins or olefins in which the double bond is randomly distributed along the chain, paraffin sulfonates having from 10 to 20 carbon atoms, and N-(2-hydroxyalkyl)-amino acids having from 10 to 20 carbon atoms in the alkyl chain.

The alkyl benzene sulfonates and alkyl toluene sulfonates may be prepared by sulfonating the corresponding alkylaromatic hydrocarbons. The oldest sulfonation processes utilize 100% sulfuric acid or weak oleum, although anhydrous sulfur trioxide can also be used. Excess unsaponifiable material is removed from the sulfonation mixture prior to neutralization to obtain alkylarylsulfonates of low salt content. The resulting alkali alkylarylsulfonates may be deodorized by treating with superheated steam or hot nitrogen gas. The color can be substantially removed from the alkali alkylarylsulfonates by treating an aqueous solution of the sulfonate with hydrogen and a hydrogenation catalyst at elevated temperatures.

The sulfonated and sulfated alcohols are produced by sulfation or sulfonation of the alcohols such as are produced from coconut oil, tallow, or palm seed oil by esterification of the fatty acids with lower aliphatic alcohols and reduction of the mixture of esters with sodium. Sulfonation is carried out at elevated temperatures with fuming sulfuric acid, sulfur trioxide, or chlorsulfonic acid.

The alcohol ethoxamer sulfates suitable for use in the present invention are derived from linear aliphatic alcohols having a carbon chain of from about 10–20 which has been reacted with from about 1–6 moles of ethylene oxide. The longer the alkyl group, the more moles of ethylene oxide can be reacted with a mole of the alcohol. The alcohol ethoxamer sulfates are commonly prepared by reaction of the appropriate alcohol with sufficient ethylene oxide followed by sulfation of the reaction product in known manner, such as by the use of oleum or chlorsulfonic acid.

The purity of the desired reaction product is a consideration for the manufacture of a product having optimum properties. Depending upon the method of manufacture, there is usually present varying amounts of organic impurities in admixture with the sulfated ethoxamer compounds. The organic impurities may include unreacted nonionic (unsulfated) alkyl ethylene oxide materials and small amounts of degradation products such as partially de-ethoxylated products. These organic impurities should be maintained at a minimum since an excessive amount has been found to adversely affect the physical properties and performance of the product. More particularly, an excessive amount, particularly of the unreacted nonionic polyethoxamer, has a tendency to raise the cloud point, inhibit foam, and decrease the efficiency of the product as an emulsifier of greasy soil in washing operations. The product may contain a minor amount of such organic unreacted or by-product materials provided that the amount is insufficient to substantially adversely affect the properties of the product. In general, the alkyl polyethoxamer sulfate material should have a purity of at least about 75% by weight of the total organic solids in said material with up to about 25% of said other organic solids. For optimum effects, it is preferred that the organic solids of the polyethoxamer sulfate should contain not substantially in excess of about 10% unsulfated organic ethoxamer material and not in excess of about 15% ring sulfonated material by weight of the organic solids in the polyethoxamer sulfate material. A typical product may contain about 10% of each on an organic solids basis. The impurities are maintained at these low levels by any suitable technique. The careful control of conditions in the sulfation procedure including the time of reaction and the choice of sulfonating agent will produce materials of desired purity. The reaction product may be purified to remove said organic impurities also, such as by the use of an ion-exchange technique.

The soaps for use in the present invention are soaps of carboxylic acids having a carbon chain length of from about 10 to 20 carbon atoms. Water-soluble soaps such as the sodium and potassium and other suitable alkali metal or ammonium soaps of nitrogen bases, such as triethanolamine, derived from fats and oils such as tallow, coconut oil, cottonseed oil, soybean oil, corn oil, olive oil, palm oil, peanut oil, palm kernel oil, lard, greases, fish oils, and the like, as well as their hydrogenated derivatives and mixtures thereof, may be used in the fabric treating formulations of the present invention.

The olefin sulfonates for use in the present invention can be made from Fischer-Tropsch hydrocarbons, made by the hydrogenation of carbon monoxide, which contains a relatively high proportion of straight-chain olefins. The sulfonation is carried out at low temperatures to avoid polymerization and side reactions. Certain fractions of shale oil are rich in olefins, which can be sulfonated to form anionic surfactants. The starting materials and the final product, however, require considerable purification of surfactants if good color and softening characteristics are to be obtained.

To prepare paraffin sulfonates for use in the present invention, the paraffins are oxidized to fatty acids by air-blowing at temperatures below 150°C. in the presence of small amounts of potassium permanganate. An alternative oxidation process involves oxidation with nitrogen dioxides dissolved in sulfuric acid. The resulting acids are then sulfonated by conventional means, such as by the use of oleum or chlorsulfonic acid.

To prepare N-(2-hydroxyalkyl)-amino acids for use in the present invention, epoxidized alpha olefins are reacted with amino acids such as sarcosine (N-methyl glycide) and imino diacetic acid. A typical acid for use in the compositions of the present invention is N-(2-hydroxyalkyl) sarcosine.

The anionic surfactants are dissolved in water to make a solution which can be sprayed directly onto wet or dry fabrics. The anionic surfactant may be present in amounts ranging from about 0.5 to about 10% by weight, and preferably from about 1 to about 5% by weight. In addition to the anionic surfactant, the fabric treating compositions of the present invention may contain perfumes, germicides, and agents to resist attack of fungus and mildew. Mixtures of two or more anionic surfactants may be used in these fabric treating compositions.

Additionally, an ironing aid formula can be prepared from the anionic surfactants of the present invention, a silicone polymer lubricant, and an organic solvent in addition to the water. The most commonly used silicone lubricants are the dimethylpolysiloxane fluids, which aid in pushing the iron over the fabric being ironed. The amount of silicone lubricant needed in such compositions is minor, ranging from about 0.15 to about 1.5%. To aid in dispersing the silicone polymer in the aqueous medium, an organic solvent is used in amounts ranging from about 5 to about 20%; the preferred organic solvents are ethanol, propanol, isopropanol, and ethylene glycol. As in previous compositions, the anionic surfactant may be present in amounts ranging from about 0.5 to about 10%.

The preferred form of application of the product is from pressure cans of the "aerosol" type, such as are common for household uses. The general technology of such gas-pressurized cans is applicable in this disclosure, and need not be set forth in detail. Gases such as nitrogen, isobutane, Freon, and carbon dioxide are useful as the expelling medium.

The product is preferably applied to the fabrics by placing the fabrics horizontally on a surface such as an ironing board. The can is held approximately 18–24 inches away, and the spray is applied lightly and evenly over the entire surface. Particular areas of the fabric may be treated with heavier sprays where greater softening and/or soil release are required. While the preferred means of application is from a gas pressure bottle or can, it is apparent that mechanical spray operations may also be used.

DESCRIPTION OF THE PREFERRED EMBODIMENTS

EXAMPLE I

SOIL-RELEASE TESTS

Fabric treating compositions were formulated from 1% of the following anionic surfactants:

A. Tallow alcohol sulfate
B. Linear tridecyl benzene sulfonate
C. Sodium lauryl sulfate These anionics were compared against a well-known cationic fabric softener:

D. Di-hydrogenated tallow dimethyl ammonium chloride

The fabric treating compositions were sprayed onto 80 × 80 cotton and 80 × 80 polyester/cotton (65% polyester, 35% cotton) with permanent press finish swatches (No. 7406, Testfabrics, Inc.). The swatches were ironed dry, stained with mustard or blackberry juice, and aged overnight.

The swatches were then each washed with 5 ml. of a 0.5% solution of synthetic detergent (18% anionic, 7% silicate, 33% sodium tripolyphosphate) in 500 ml. of water of 90 ppm. hardness at 120°F. for ten minutes. The swatches were air-dried and compared visually according to the following scale:

−2 much worse than no treatment
−1 somewhat worse than no treatment
0 same as no treatment
+1 somewhat better than no treatment
+2 much better than no treatment The results of the comparison are tabulated below:

| Treatment | Cotton | | Polyester/Cotton | |
|---|---|---|---|---|
| | Mustard | Blackberry | Mustard | Blackberry |
| A | +2 | +1 | +1 | +2 |
| B | +2 | +1 | +1 | +1 |
| C | +1 | 0 | 0 | +1 |
| D | −2 | −2 | −2 | −2 |

The above results show that the anionic surfactant fabric treatment compositions of this invention give much better soil release than a well-known cationic softener.

EXAMPLE II

SOFTENING TESTS

The following aqueous solutions were made up to be sprayed onto fabrics:

A. Control-water only
B. 2% Di-hydrogenated tallow dimethyl ammonium chloride
C. 1% Linear tridecyl benzene sulfonate
D. 3% Linear tridecyl benzene sulfonate Cotton swatches (80 × 80) were sprayed with the solutions described above and ironed to dryness with a General Electric hand iron. The swatches were then rated by a panel of seven people for softness. The following table shows the number of preference votes for each treating solution:

| | A vs. B | A vs. D | B vs. D | B vs. C |
|---|---|---|---|---|
| A | 0 | 0 | | |
| B | 7 | | 2 | 2 |
| C | | | | 5 |
| D | | 7 | 5 | |

The following table shows preferences of anionics tested for softness when rated by a panel of seven, the anionics being used at 1% concentration:

| Softener | 1st Choice | 2nd Choice | 3rd Choice |
|---|---|---|---|
| Linear tridecyl benzene sulfonate | 5 | 1 | 0 |
| Sodium lauryl sulfate | 0 | 1 | 1 |
| Tallow alcohol sulfate | 1 | 1 | 2 |

-continued

| Softener | 1st Choice | 2nd Choice | 3rd Choice |
|---|---|---|---|
| Linear dodecyl benzene sulfonate | 0 | 4 | 0 |
| Linear dodecyl benzene sulfonate/ amine oxide | 1 | 0 | 4 |
| Control (water) | 0 | 0 | 0 |

EXAMPLE III

IRONING AID FORMULA

A preferred ironing aid formula incorporating an anionic surfactant and imparting good softness and soil release to fabrics treated therewith was formulated as follows:

| | Percent by Weight |
|---|---|
| Silicone polymer* | 0.5 |
| Ethanol | 10.0 |
| Linear tridecyl benzene sulfonate | 1.0 |
| Deionized water | 88.5 |

*35% AI oil-in-water emulsion of dimethylpolysiloxane silicone of viscosity 60,000 ±5 centistokes A stiffening agent may be included in the iron aid to aid in keeping wrinkles from reforming immediately after ironing. A 0.5% by weight concentration of starch or other film forming agent was found to be adequate.

Ironing aid compositions were formulated as follows:

| | | % by weight |
|---|---|---|
| A. | 5% solution of the following: | |
| | Di-hydrogenated tallow dimethyl ammonium chloride | 2.92 |
| | Linear tridecyl benzene sulfonate | 16.90 |
| | Ethanol | 50.00 |
| | Deionized water | 20.18 |
| B. | 5% solution of linear tridecyl benzene sulfonate | |
| C. | 5% solution of equal parts of ethoxylated fatty alcohol ($C_{14}$-$C_{15}$ alcohol ethoxylated with 11 moles of ethylene oxide) and di-hydrogenated tallow dimethyl ammonium chloride | |
| D. | 5% solution of the following: | |
| | 10% solution of linear tridecyl benzene sulfonate | 50 g. |
| | Stearyl dimethyl amine oxide | 20 g. |
| E. | 5% solution of N-(2-hydroxy octadecyl)-sarcosine, sodium salt | |
| F. | 5% solution of N-(2-hydroxy hexadecyl)-sarcosine, sodium salt | |
| G. | 5% solution of N-(2-hydroxy dodecyl)-sarcosine, sodium salt | |
| H. | 5% solution of sodium lauryl sulfate | |

The properties of the above compositions are tabulated below:

| Composition | Appearance | Ironing ease without silicone |
|---|---|---|
| A | two-phase solution | iron drags a little |
| B | one-phase solution | average (no drag) |
| C | two-phase solution | iron drags a little |
| D | opaque white (viscous) | iron drags |
| E | white (viscous) | easy ironing |
| F | hazy solution | easy ironing |
| G | hazy solution | easy ironing |
| H | one-phase solution | easy ironing |

Ironing aids incorporating a small amount of starch were formulated as follows:

| | % by weight | |
|---|---|---|
| Silicone polymer (dimethyl polysiloxane) | 0.5 | 0.2 |

-continued

| | % by weight | |
|---|---|---|
| Ethanol | 10.0 | 5.0 |
| General Electric Antifoam 20 | 0.5 | 0.2 |
| Perfume | 0.03 | 0.05 |
| Linear tridecyl benzene sulfonate | 1.0 | 1.0 |
| Starch | 0.5 | 1.0 |
| Deionized water | 87.47 | 82.55 |

EXAMPLE IV

Ironing aids can be formulated from mixtures of anionic surfactants, including soap, as follows:

| | % by weight | |
|---|---|---|
| Dimethylpolysiloxane polymer | 0.5 | 0.5 |
| Ethanol | 10.0 | 10.0 |
| Linear tridecyl benzene sulfonate | 1.0 | 1.0 |
| Soap (sodium soap of mixed coconut and tallow acids) | 2.0 | 1.0 |
| Deionized water | 86.45 | 87.0 |
| Perfume | 0.5 | 0.5 |

The fabric treating compositions of the present invention give excellent fabric softening and soil-release characteristics to fabrics treated therewith. The compositions of the present invention are generally lower in cost than the traditionally used cationic softeners. Since cationics are substantive to cotton and tend to hold onto soils, the anionics, which are not substantive, give superior soil release. Since the compositions of the present invention are designed to be sprayed on, and then ironed dry or allowed to air dry, the section of textile to be treated may be selected, rather than treating the entire textile as in the washing machine softening method. Additionally, the compositions of the present invention allow a controlled amount of treatment for individual fabrics, depending on the desired effect on the fabric.

What is claimed is:

1. A fabric conditioning composition comprising a dimethylpolysiloxane polymer, water, and an anionic surfactant having a derivable pH of about 7–9 selected from the group consisting of alkyl benzene sulfonates wherein the alkyl group contains from about 10 to about 20 carbon atoms, alkyl toluene sulfonates wherein the alkyl group contains from about 10 to about 20 carbon atoms, ethoxylated alcohol sulfates produced from an aliphatic alcohol having from about 10 to about 20 carbon atoms ethoxylated with from about 1 to about 6 moles of ethylene oxide, soaps of fatty acids having from about 10 to about 20 carbon atoms, paraffin sulfonates having from about 10 to about 20 carbon atoms, N-(2-hydroxyalkyl)-amino acids having from 10 to 20 carbon atoms in the alkyl chain, and mixtures thereof.

2. The fabric conditioning composition of claim 1 wherein the anionic surfactant is present in amounts ranging from about 0.5 to about 10.0%, and the dimethylpolysiloxane polymer is present in amounts ranging from about 0.15 to about 1.5%.

3. The fabric conditioning composition of claim 1 wherein the anionic surfactant is linear tridecyl benzene sulfonate.

* * * * *